United States Patent [19]

Busch

[11] Patent Number: 4,484,662

[45] Date of Patent: Nov. 27, 1984

[54] METHOD AND APPARATUS FOR HANDLING BAGS AT A CHECK-OUT COUNTER

[76] Inventor: Bjarne G. Busch, Lövhagsgatan 85, Postbox 13033, S-720 13 Västeras, Sweden

[21] Appl. No.: 69,093

[22] Filed: Aug. 23, 1979

[30] Foreign Application Priority Data

Feb. 24, 1978 [SE] Sweden ..... 7802145

[51] Int. Cl.[3] ..... B65B 67/12

[52] U.S. Cl. ..... 186/66; 53/385

[58] Field of Search ..... 186/66, 67, 68; 225/100, 101; 53/385

[56] References Cited

U.S. PATENT DOCUMENTS 3,956,866 5/1976 Lattur ..... 53/385 X 4,062,170 12/1977 Orem ..... 186/66 X

*Primary Examiner*—Stanley H. Tollberg

*Attorney, Agent, or Firm*—Stevens, Davis, Miller & Mosher

[57] ABSTRACT

A bag handling method and apparatus for a check-out counter are disclosed. A strip of serially connected bags having their bottoms leading their tops in the direction of strip movement are intermittently fed from a roll to an edge of the counter where the bottom of the leading bag is fed into a carriage provided in a recess in the counter. When the leading bag reaches a predetermined location, advancement of the strip is stopped while the leading bag continues to be transported into the recess carriage causing separation of the leading bag from the strip. After separation, vacuum jaws engage with the sides of the leading bag and open the same and flaps are inserted into the bag opening to retain the opened condition. After the leading bag is filled with articles, the flaps are removed and the recess carriage transfers the filled bag to a pick-up basket.

8 Claims, 3 Drawing Figures

A-A

B-B

METHOD AND APPARATUS FOR HANDLING BAGS AT A CHECK-OUT COUNTER

Figure 1:
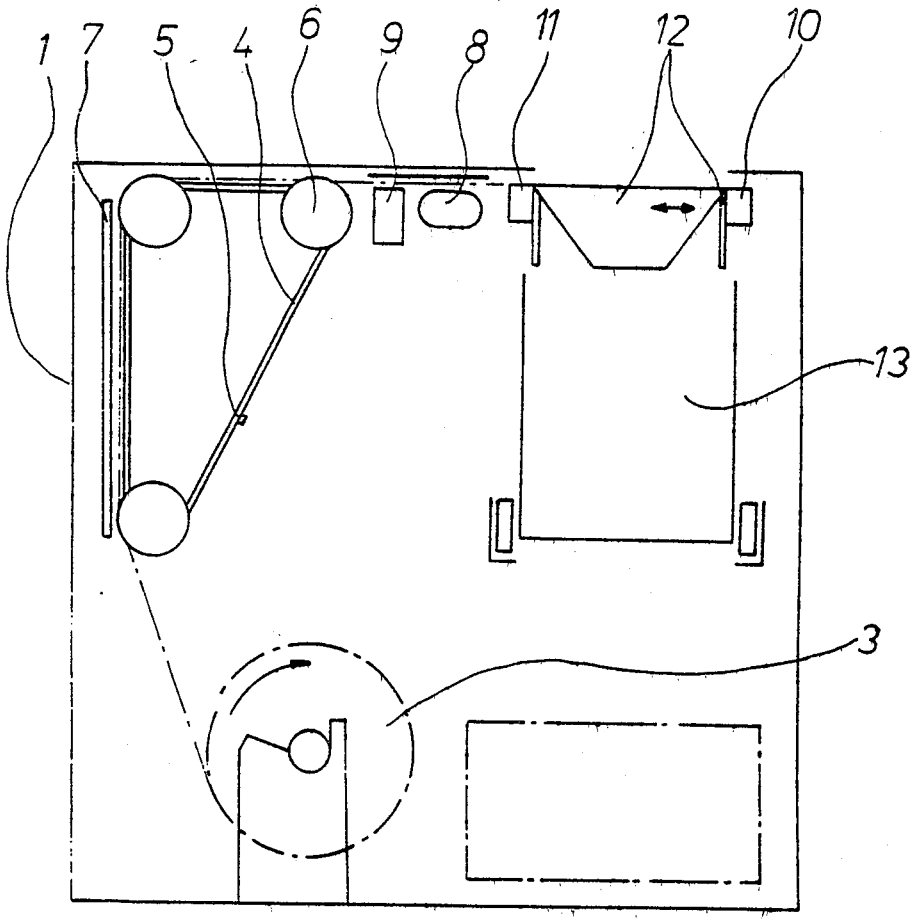

This invention relates to a method for mechanically handling of grocery bags and to a checkout counter for carrying out of the method.

Upon the sale of goods in self-service stores, particularly department stores, the customers, after they have made the purchase, go to checkout counters where they must show the goods to the cashier who records the prices, for which she must take each article in her hand and read off the price, whereupon the articles as a rule are transported on a conveyor belt up to the end of the checkout counter where the customer takes them over. The heretofore customary handling of the goods, particularly in the case of larger quantity purchases, has certain disadvantages, such as loss of time due to the double handling, and lengthy waiting periods which are furthermore increased if there are not a sufficient number of grocery bags and new ones must be obtained, which constitutes a great burden for the personnel at the counter.

The object of the present invention is to simplify the procedures upon passage by the checkout counter and to obtain a considerable simplification here in particular by doing away with the double handling of the goods by the cashier and the customer, as was heretofore necessary. In addition the quality of the goods is not to be impaired or the goods damaged, as for instance happens when bags brought along by the customer and generally consisting of plastic tear, which results in unnecessarily long waiting times. Furthermore the protection of the goods should also be assured upon transportation after the customer has left the checkout counter.

This purpose is achieved in accordance with the invention in the manner that a strip of grocery bags is conducted from a supply, with the bottom of the bags towards the front, to and over the edge of a container which is open on top, the bag which is located at the front of the strip as seen in the direction of movement of the strip being lowered into the container during the advance, that the advance of the strip of bags is interrupted when the upper edges lying between the handles on the first bag have reached the front edge of the container, that a bag is removed from the strip by pull exerted on the strip while it is held stationary, that the sides of the bag separated from the strip and hanging into the container are moved apart and held fast, the mouth of the bag being held for introduction of articles in the direction of the opening of the container, and that the bag is released and removed from the container.

The invention therefore provides a faster handling of the goods, in which the handling of the goods for the reading of the price is combined with the introduction of the goods into one or more grocery bags which the customer can receive without loss of time. It is obvious that the saving in time is substantial, particularly at times when there is a very large crowd and frequently extra personnel must be used in order to accelerate the packing of the articles. Aside from the gain in time and the savings indicated the invention also leads to an undisturbed flow of the customers past the counter. The above-mentioned safety in transportation is assured by the selection of suitable material for the grocery bags, by the nature and manner of the handling of the bags in accordance with the invention, and by the uniformity of the bags.

Figure 2:
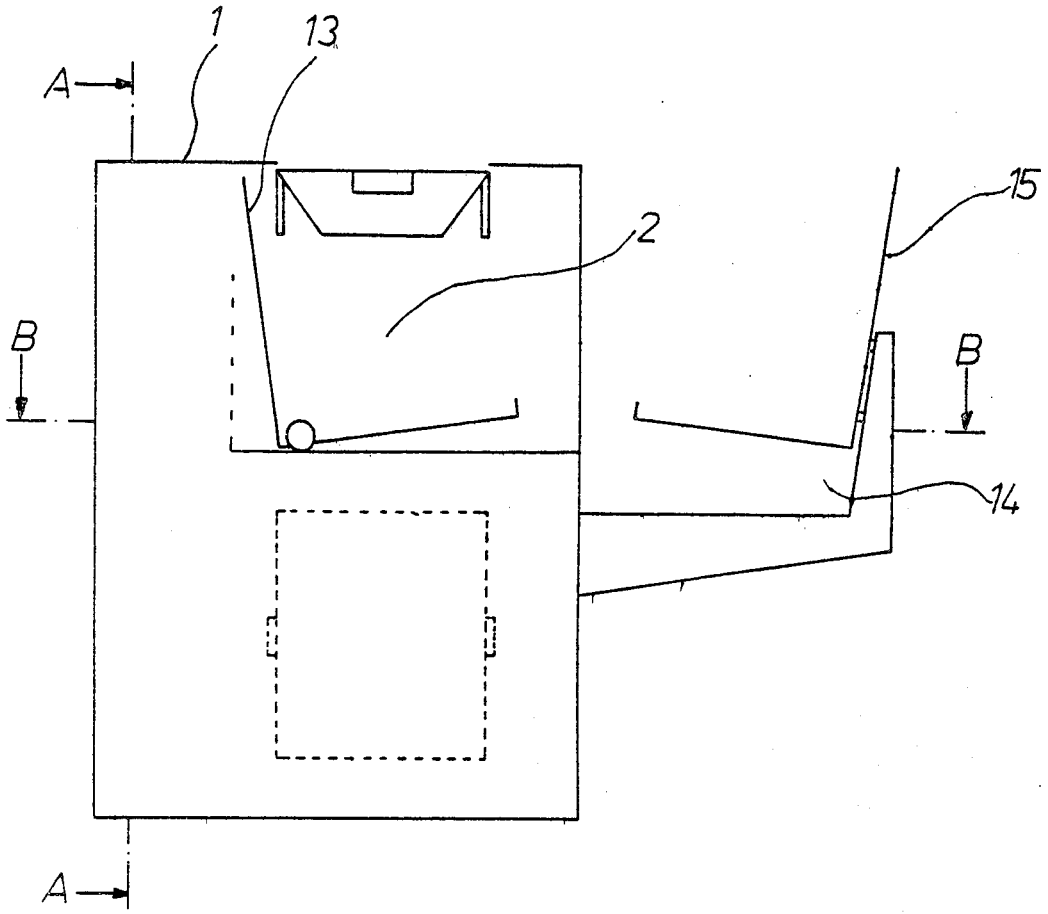
Figure 3:
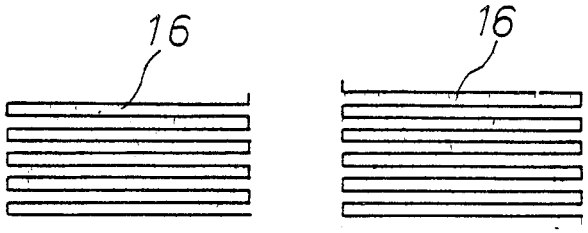

The invention will be described in further detail below with reference to the drawings in which FIG. 1 diagrammatically shows a section through a checkout counter along the Line A—A in FIG. 2, FIG. 2 shows a front view of a checkout counter, and FIG. 3 is a view of the checkout counter along the Line B—B of FIG. 2.

The housing 1 of an ordinary checkout counter is provided with a recess 2 which extends downward from the table top of the checkout counter into the inside thereof and serves as container for grocery bags. The grocery bags are provided as part of a strip which consists of interconnected bags and in the example shown is supported as a roll 3 in the lower part of the checkout counter. From here the grocery bags are conducted to a driving device which consists of two endless belts 4 arranged parallel to each other which are guided over three guide rollers 6 having recesses to receive the belts 4. Drivers 5 are arranged on these belts 4. The grocery bag is conducted over the belts 4 and transported by them by engagement of the drivers 5 into cut-outs in the bag, the bag being held securely by holding device 7. In the example shown, this holding device 7 consists of rails which are swingably arranged in the region of the belts 4 and are pressed by means of springs against the grocery bag so that the driver 5 which engages into the cut-out in the grocery bag cannot jump out of same.

Upon the introduction of the first grocery bag of a new strip of bags the holding device 7 is lifted off so that the first bag can be applied against the belts 4, the driver 5 being inserted into the cut-out in the bag whereupon the holding device 7 is placed against the bag. The holding device 7 is then held in this position by its springs. This process is carried out only upon the introducing of a new strip of grocery bags into the counter. By a starting device (not shown) which is operated by the cashier, a driver is started which acts on one or more of the guide rollers 6. The bag is pushed forward with its bottom towards the front by means of a conveyor device 8 up to the recess 2 where the bag is inserted into the container. As soon as the upper edge of the bag, which lies between its handles, has reached the edge of the recess 2, a clamping device 9 is actuated by means of contact-less sensors (not shown) and the clamping device presses the bags against the bottom of the counter top, as a result of which, due to the continued transport movement of the bag which is first in line, said bag is separated by means of the transport device 8 from the strip of other bags. At the same time the further transporting of the strip of bags is stopped. The sensors then give off a signal to a servo device (not shown) which brings about the movement, transversely over the recess 2, of a pair of vacuum jaws 10 towards the bag, which still hangs unopened in the container and up to a second pair of stationary vacuum jaws 11 which holds the one side of the bag fast by suction, whereupon the first mentioned pair of vacuum jaws 10 is moved back into its original position at the same time taking the longitudinal side of the bag with them, as a result of which the bag is opened. Now four conically shaped flaps 12 are swung down from a horizontal position into the bag, as a result of which the mouth of the bag is held open for the insertion of the articles.

As soon as the articles purchased have been inserted or the bag is full, the flaps 12 are swung upward into their horizontal position. The vacuum jaws 10, 11 release the sides of the bag by actuation of the servo device so that the bag stands free in the container. Within the latter there is a basket or carriage 13 which assumes a rearwardly inclined position so that its bottom is at an angle to the bottom of the recess 2. The basket 13 is now pushed, for instance by a device operated by compressed air, through an opening in the side of the checkout counter outwards into a container 14 the bottom of which lies somewhat below the bottom of the recess 2 in the checkout counter. There, there is a basket 15 in a position inclined in the direction opposite the inclination of the basket 13. The front side of the basket 13 which faces the opening in the sidewall of the counter and the rear side of the basket 15 which also faces this opening in the counter are open. The bottoms of the baskets are developed like forks 16 so that the bottom of the basket 13 can enter into the slots in the fork shaped bottom of the basket 15. The basket 13 falls forward into the container 14. In this way the bag is placed on the bottom of the basket 15, from which it can be removed by the customer. The basket 13 is brought back into its original position in the recess 2 whereby the device in accordance with the invention is ready to feed and fill a new bag. The container 14 can of course also be imparted some other dimensioning so that several bags can be inserted simultaneously.

Numerous variations of the arrangement and modifications of the shape of the arrangements or their drives as compared with the embodiment shown are possible without going beyond the scope of the invention.

I claim:

1. A method for automatically handling grocery bags at a checkout counter comprising the steps of :

advancing a strip of separable, interconnected grocery bags in which the top edges of one grocery bag are connected to the bottom of a following grocery bag forward over the edge of an open container, the bottom of the leading bag of said strip being lowered during said forward advancement into said container;

interrupting the advancing of said strip when the top edges of said leading bag approach a front edge of said container, said leading bag then hanging down into said container;

holding said strip stationary during the interruption of said strip advancement at a position removed from said leading bag and pulling said leading bag from said held strip to separate it therefrom;

moving the sides of said leading grocery bag apart and holding said sides apart such that the mouth of said leading bag is held open in the direction of said container opening to permit introduction of articles into said bag; and, releasing the sides of said leading grocery bag to permit removal of said leading grocery bag from said container.

2. An apparatus for automatically handling grocery bags at a checkout counter comprising:

a counter top for receiving articles sold;

a supply of grocery bags interconnected in a strip with the top of each grocery bag being connected to the bottom of the following grocery bag, said grocery bags being separable at the point of interconnection;

a drive mechanism for engaging with said bags to move said strip and transport said bags step by step from said supply to a strip outlet, each said step corresponding to the length of a bag in said strip, said bags advancing bottom first;

a container provided in a recess in said counter top, said container having an upwardly opening top located adjacent said strip outlet, said container receiving the bottom of the leading bag of said strip as said strip advances;

a bag severing mechanism comprising means for periodically holding said strip at a position removed from said leading bag and for transporting said leading bag from said held strip into said container; and, at least two vacuum jaws for engaging with the sides of said leading bag in said container to open said bag and permit insertion of articles therein.

3. An apparatus for automatically handling grocery bags as in claim 2 wherein said drive mechanism is arranged below said counter top and said bags have cutouts which are engaged by said drive mechanism for step-wise transporting said strip.

4. An apparatus for automatically handling grocery bags as in claim 2 wherein said severing mechanism comprises a periodically actuated clamping device provided between said drive mechanism and strip outlet for engaging with said strip and a transporting device provided between said clamping device and strip outlet which, during actuation of said clamping device, transports said leading bag away from said clamped strip.

5. An apparatus for automatically handling grocery bags as in claim 2 wherein at least one of said vacuum jaws is fixed on a side of said recess facing said strip outlet and at least one vacuum jaw is located on the opposite side of said recess and is movable over said recess to engage a side of said leading bag.

6. An apparatus for automatically handling grocery bags as in claim 3 wherein said drive mechanism comprises at least one endless belt guided over guide rollers, said endless belt having a driving element which engages with the cutouts of said bags.

7. An apparatus for automatically handling grocery bags as in claim 2 or 5 further comprising flaps provided on the edges of the opening of said recess which swing down for opening and holding fast the mouth of said leading bag.

8. An apparatus for automatically handling grocery bags as in claim 6 further comprising a holding device for ensuring engagement of said driving element with the cutouts of said bags.

* * * * *